United States Patent [19]

Purser

[11] Patent Number: 5,004,168

[45] Date of Patent: Apr. 2, 1991

[54] CRUSHING APPARATUS

[76] Inventor: Brian Purser, c/o The Dudley Shearing Machine Manufacturing Co. Ltd., Nevada Lane, Hot Lane Industrial Estate, Burslem, Stoke-on-Trent, Great Britain, ST6 2BY

[21] Appl. No.: 435,339

[22] Filed: Nov. 13, 1989

[51] Int. Cl.[5] ..... B02C 1/10

[52] U.S. Cl. ..... 241/101.7; 241/264

[58] Field of Search ..... 30/134, 228, 180; 83/694; 414/739, 740; 299/85, 88, 67; 125/23 R; 225/23, 103; 294/106, 902; 241/101.7, 264–269

[56] References Cited

U.S. PATENT DOCUMENTS

| | | | |
|---|---|---|---|
| 4,512,524 | 4/1985 | Shigemizu . | |
| 4,543,719 | 10/1985 | Pardoe | 30/134 |
| 4,776,524 | 10/1988 | Sakato | 241/101.7 |
| 4,890,798 | 1/1990 | Tagawa et al. . | |
| 4,932,597 | 6/1990 | Bieri . | |
| 4,934,616 | 6/1990 | Zepf | 241/101.7 X |
| 4,951,886 | 8/1990 | Berto | 241/101.7 |

*Primary Examiner*—Mark Rosenbaum
*Attorney, Agent, or Firm*—W. Thad Adams, III

[57] ABSTRACT

An apparatus for breaking relatively brittle material such as stone which includes a first jaw having a material engaging surface and a free end and a second jaw having a relatively angled material supporting surface and a free end. The first and second jaws are connected in opposing relation to each other adjacent an end opposite the respective free ends for pivotal movement relative to each other between a relatively open material receiving position wherein the respective free ends of the first and second jaws are each widely spaced-apart to define a material entry space between the jaws and to receive a quantity of material to be broken and a relatively closed material breaking position wherein the free ends of the first and second jaws are closely adjacent to or abutting each other at an angle to force the material into the space between the jaws, and the engaging and supporting surfaces of the first and second jaws oppose each other in spaced-apart relation to define between them a relatively large dimension material holding space approximating the thickness of the first jaw to prevent reduction of the breaking action by entrapment of material particles between the first and second jaws. A hydraulic piston and cylinder assembly is used to move the first and second jaws. The rock breaking apparatus is mounted on a supporting structure such as a back hoe.

12 Claims, 4 Drawing Sheets

CRUSHING APPARATUS

BACKGROUND OF THE INVENTION

The invention relates to apparatus for crushing or cracking tough materials, such as all types of rock, concrete, slag and cast iron, the apparatus being mounted in use on an hydraulically-powered arm of a excavating vehicle. the term "excavating vehicle" as used herein means a vehicle having wheels or which is track-laying having an arm of one or more articulated portions, said arm being powered wholly or partially by hydraulic power and usually having mounted at an extremity of the arm a bucket for earth excavation or some other tool, for example a pneumatic or hydraulic percussion device, or means for manipulating objects such as telegraph poles, posts and the like.

Apparatus of the present invention is particularly suited for secondary breaking in a quarry i.e. after blasting but before static crushing. This is often required, or at least preferable, to permit transportation of the material. Conventionally such breaking has been accomplished using a drop ball or hydraulic hammer which presents various disadvantages and does not provide for uniform crushing of material.

The present invention seeds to provide crushing apparatus for attachment to existing vehicles, which apparatus is powerful enough to crush substantial volumes of tough material. The invention also seeks to provide a vehicle having such apparatus fitted thereto.

SUMMARY OF THE INVENTION

The invention provides therefore crushing apparatus adapted for attachment to an arm of an excavating vehicle, the apparatus comprising a first member having a jaw on an end thereof and, remote from said jaw, fixing means by which the first member may be mounted on the vehicle arm, a second member movably mounted on said first member and having a jaw co-operable with the jaw of said first member to crush material located therebetween, and a piston and cylinder assembly mounted on one of said first and second members and connected to the other of said first and second members and operable to cause relative movement between said jaws.

The piston and cylinder assembly provided on the apparatus is preferably hydraulically driven and may be driven by the hydraulic compressor of the vehicle to which it is, in use, attached.

Preferably the second member is pivotally mounted on the first member.

Desirably the first member comprises a pair of spaced apart limbs between which the second member is mounted. Corresponding bearing surfaces are preferably provided on the inner faces of said limbs and on the second member to prevent relative sideways or twisting movement between the first and second members Preferabaly at least one of the jaws is provided with means for engaging with material to be crushed. The engaging means may comprise a plurality of projections which are desirably spikes.

Preferabaly the cylinder of the piston and cylinder assembly is mounted for limited pivotal movement on the first member at a point between the ends of said first member and the piston is pivotally connected at its end to the second member.

The fixing means desirably comprises a pair of pivotal mountings, one of said mountings being co-operable with the mounting provided on the vehicle arm for use normally with an excavating bucket, the second of said mountings being co-operable with the mounting provided on the piston or cylinder of an excavating-bucket-tilting ram provided on said vehicle arm. A plurality of fixing means may be provided to allow the apparatus to be transferred from one vehicle to another different vehicle having different fixings.

The present invention also provides an excavating vehicle, as hereinbefore defined, fitted with apparatus according to any of the preceding seven paragraphs.

Embodiments of the invention will now be described by way of example only with reference to the accompanying drawings in which:

DETAILED DESCRIPTION

Figure 1:
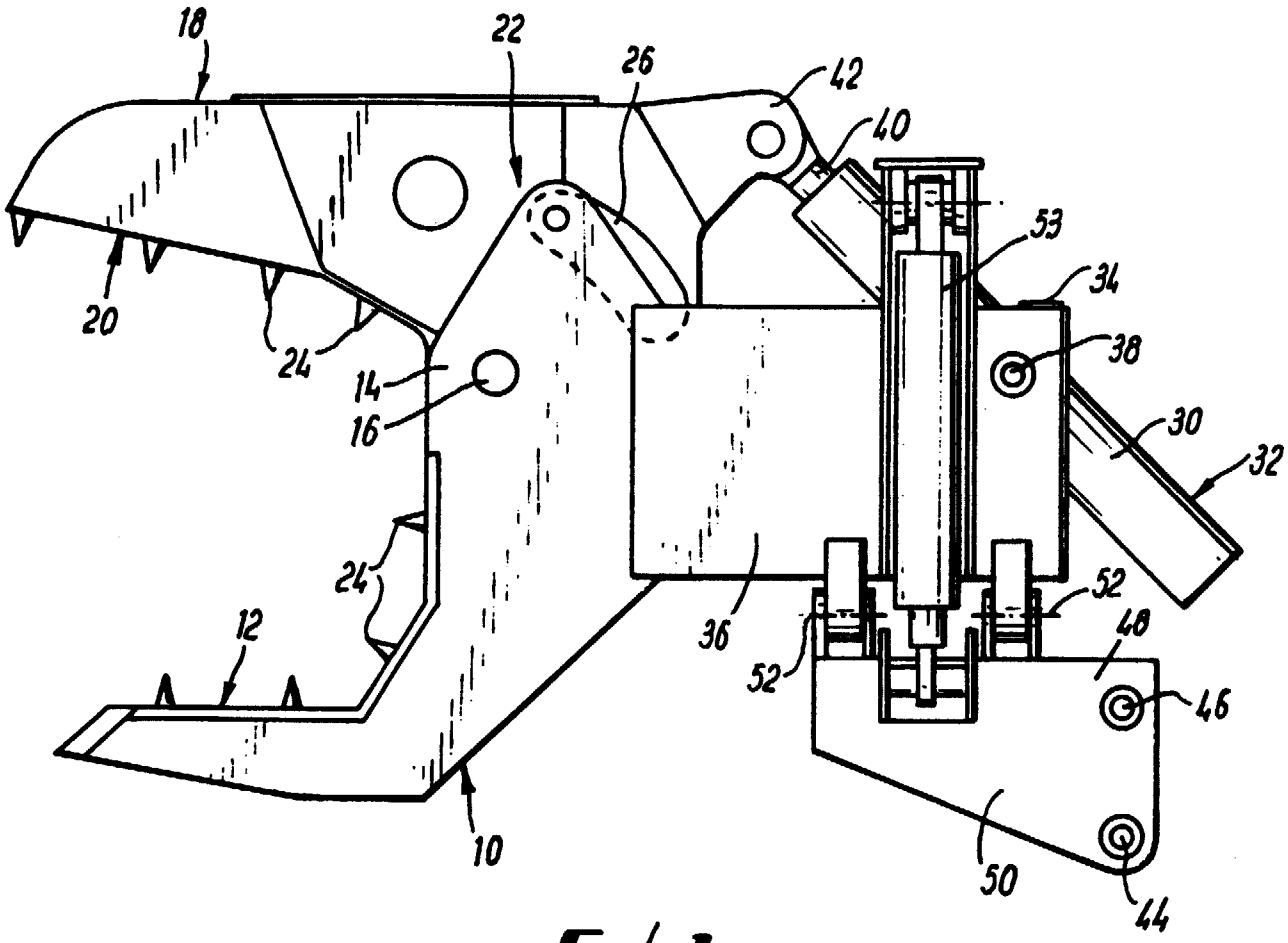
FIG. 1 is a side view of a crushing apparatus attachment.
Figure 2:
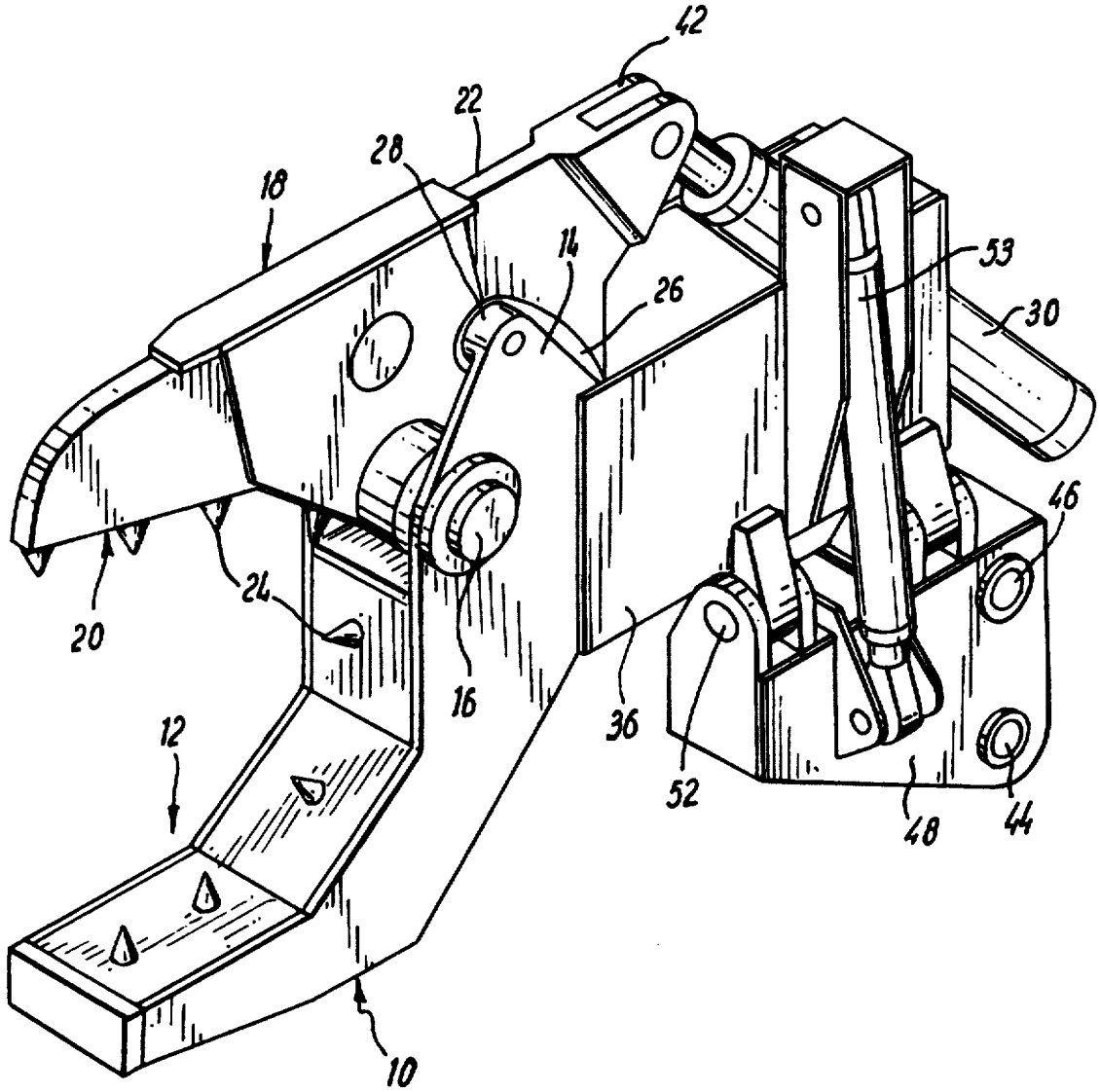
FIG. 2 is a perspective view of the attachment of FIG. 1.

The attachment shown in the drawings comprises a first member 10 comprising a jaw portion 12 at one end from which extends two spaced parallel mounting members 14. A pivot 16 is provided between the members 14 and on this pivot is mounted a second member 18. The member 18 has a jaw portion 20 at one end which connects with a mounting portion 22 rotatable about the pivot 16. Both of the jaw portions 12, 20 are provided with a plurality of spikes 24 on their inner edges. A kidney shaped projection 26 extends from each side of the mounting portion 22 and contactingly engages with a projection 28 on the inside of each of the mounting limbs 14. The engagement of the projections 26, 28 for all relative positions of the members 10, 18 restricts relative sideways or twisting movement therebetween.

A cylinder 30 of a relatively short stroke hydraulic ram 32 is mounted, by means of a beam (not shown) fixed to the cylinder between its ends, for limited pivotal movement about an axis 38 on trunnions provided on a cradle 36 welded on either side of the mounting members 14. An end region of a piston 40 of the ram 32 is pivotally connected to a yoke 42 fixed to the mounting portion 22 of the second member 18. By adopting a short stroke cylinder mounted on the first member 12 at a point between the ends thereof the overall length of the apparatus is kept to a minimum and a fast operating cycle is achieved. The length of the piston 40 and the distance between the yoke 42 and the pivot 16 are carefully selected so that as the jaws arrive at a normal crushing position the piston is substantially tangential to the arc defined by the yoke 42 as the member 18 pivots about the axis 16. This means that the maximum force is transmitted to the jaws at the time of crushing.

Figure 4:
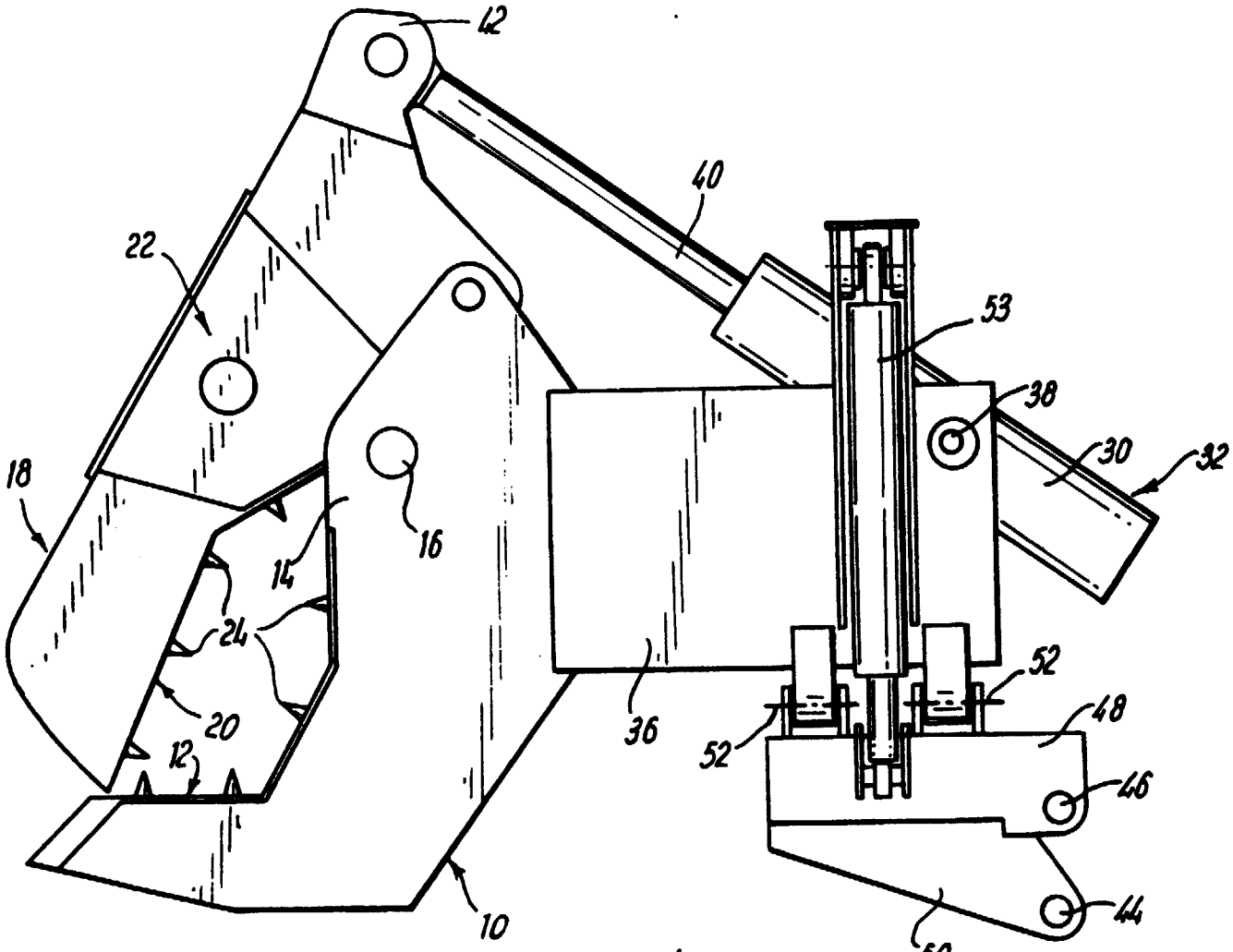
FIG. 4 is a side view of the crushing attachment with the jaws in their closed position showing the relatively large material holding space between the first and second jaws.

As is shown in FIG. 4, when the jaws 12 and 20 are in the closed position, they abut at the free ends and define a relatively large material holding space. This permits the rock to be broken and to fall out of the jaws without being pulverized into very small sand-like particles which substantially reduces the breaking action of the crusher.

An arraangement is provided for connecting the apparatus to the arm 54 of an excavating vehicle 56 for pivotting about a pivot 44 provided for the excavating bucket of the vehicle. A further pivotal fixing 46 is provided between the apparatus and the piston of the arm's bucket tilting ram 58. The apparatus is also connected for pivotting about an axis transverse to the pivot axis of the jaw portions 12, 20 comprising pivot pins 52 engaging in corresponding brackets on the cradle 36 and plate 48. The connecting arrangement comprises a mounting plate 48 pivotally mounted on the vehicle arm 54 and on the piston of the arm's bucket-tilting ram 58 by fixings 50, 46 respectively, and pivotally supporting attachment pivot pins 52 whose axes are parallel to the longitudinal axis of the apparatus. A further ram 53 is connected between the first member 10 (through the cradle 36) and the plate 48 to cause pivotal movement about the mounting pins 52 when desired. This means that the operation of the jaws is not restricted to movement in a substantially vertical plane. The jaws can operate at any angle making the attachment particularly suitable for loading crushed material directly into open topped vehicles or containers.

Figure 3:
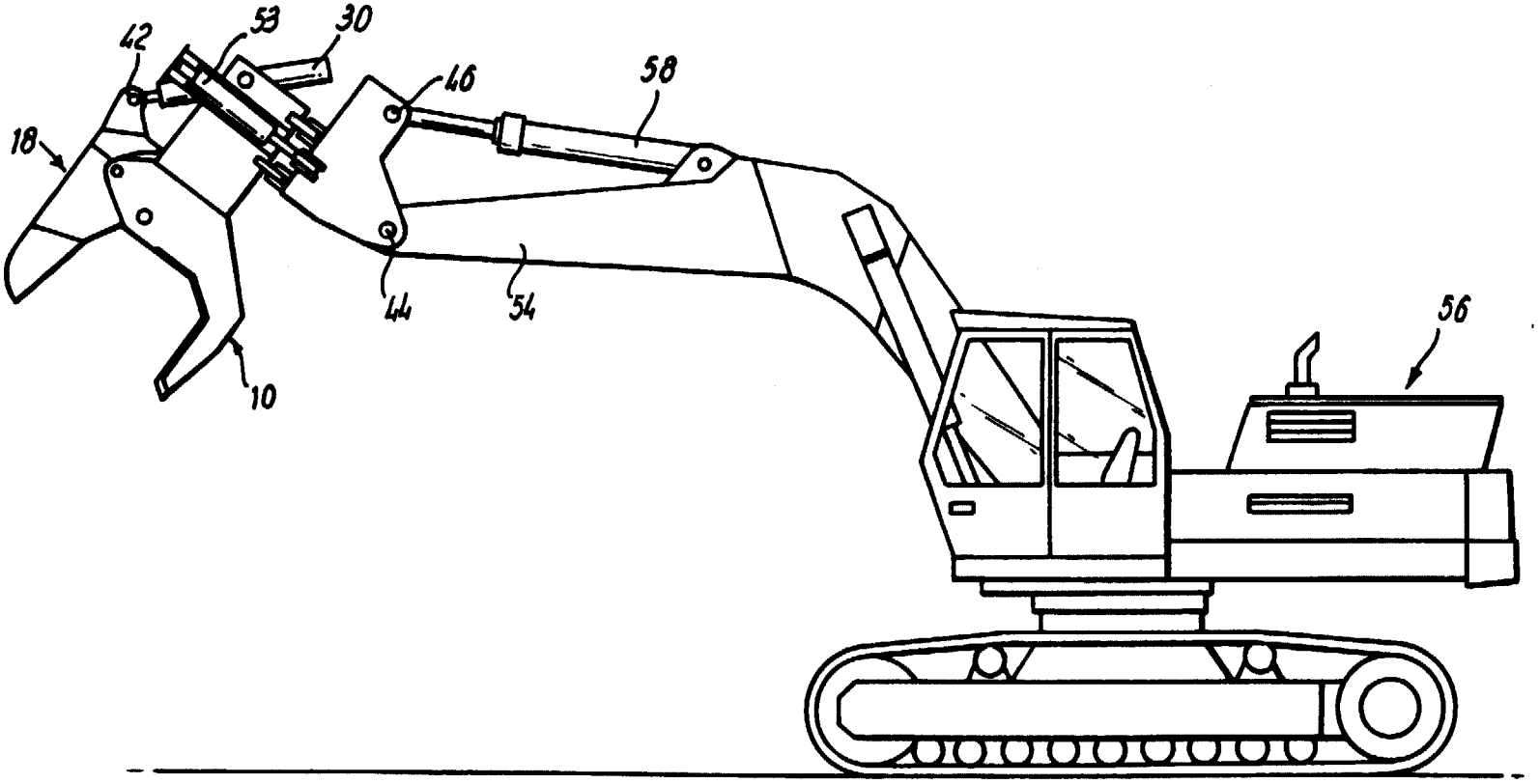
FIG. 3 is a diagrammatic side view on a reduced scale of an excavating vehicle fitted with a further crushing apparatus attachment.

Various modifications may be made within the scope of the invention. For example the jaw portions 12, 20 may be differently shaped and may have a different arrangement of spikes 24, and projections other than spikes may be used. The apparatus shown in FIG. 3 has no spikes. The projection 26 could be differently shaped or a different method of preventing sideways or twisting movement could be used.

It should be realised that by providing the apparatus with its own jaw actuating ram and mounting this ram on one of the jaws, rather than by utilising, say, the bucket operating ram of the excavator which is mounted on the excavator arm, a relatively compact, lightweight and consequently inexpensive crushing apparatus in which all the crushing forces are resisted by the components of the apparatus and are not trasmitted to the arm of the excavator is provided.

I claim:

1. An apparatus for breaking relatively brittle material such as stone, comprising:

(a) a first jaw having a material engaging surface and a free end;

(b) a second jaw having first and second relatively angled material supporting surfaces and a free end on said first material supporting surface;

(c) mounting means for stationarily mounting the second jaw in a fixed position on a supporting structure;

(d) connecting means for pivotally connecting said first jaw to said stationary second jaw in opposing relation adjacent an end opposite the respective free ends for pivotal movement of said first jaw relative to said stationary second jaw between:

(1) a relatively open material receiving position wherein the respective free ends of said first and second jaws are each widely spaced-apart to define a material entry plane between the jaws and to receive a quantity of material to be broken, the first material supporting surface of said second jaw residing generally perpendicular to the material entry plane and the second material supporting surface of said second jaw residing generally parallel to the material entry plane to collectively define a large material accommodating space within the first and second jaws; and (2) a relatively closed material breaking position wherein the free ends of said first and second jaws are closely adjacent to or abutting each other at an angle to force the material into the space between the jaws, and said engaging and supporting surfaces of the first and second jaws oppose each other in spaced-apart relation to define between them a relatively large dimension material holding space to prevent reduction of the breaking action by entrapment of material particles between the first and second jaws; and (e) powered means for accomplishing movement of said pivoting first jaw to and from said stationary second jaw.

2. Apparatus according to claim 1, wherein the material engaging surface of the first jaw is narrower than the first and second material engaging surfaces of the second jaw.

3. Apparatus according to claim 1, wherein the second jaw includes a third material supporting surface residing intermediate said first and second material supporting surfaces.

4. Apparatus according to claim 7 wherein said material engaging surface of said first jaw comprises inner and outer surface portions residing at a shallow angle to each other.

5. Apparatus according to claim 7, wherein said mounting means comprises a cradle carrying said second jaw and pivotally attached to said supporting structure about an axis perpendicular to the pivot axis between said first and second jaws, and wherein said apparatus includes a hydraulic piston and cylinder assembly being connected between said cradle and said supporting structure to pivot said cradle about said supporting structure.

6. Apparatus according to claim 7, wherein said powered means for accomplishing relative movement between said first and second jaws comprises a hydraulic piston and cylinder assembly.

7. Apparatus according to claim 7, wherein engaging means are provided on at least one of said first and second jaws for engaging with material to be broken.

8. Apparatus according to claim 7, wherein said engaging means comprises a plurality of projections.

9. Apparatus according to claim 8, wherein said projections comprise spikes.

10. Apparatus according to claim 7, wherein said projections are provided on both first and second jaws and comprise a plurality of spikes extending outwardly from one of the first and second jaws towards the other of the first and second jaws.

11. Apparatus according to claim 7 wherein the free end of the first jaw and the free end of the second jaw, when in the relatively closed material breaking position, are angled at an

12. Apparatus according to claim 7, wherein said supporting structure comprises an excavating vehicle.

* * * * *

UNITED STATES PATENT AND TRADEMARK OFFICE

CERTIFICATE OF CORRECTION

PATENT NO. : 5,004,168
DATED : April 2, 1991
INVENTOR(S) : Brian Purser

It is certified that error appears in the above-indentified patent and that said Letters Patent is hereby corrected as shown below:

Column 4:

Claim 4, line 1, please delete "7" and insert --1--.

Claim 5, line 1, please delete "7" and insert --1--.

Claim 6, line 1, please delete "7" and insert --1--.

Claim 7, line 1, please delete "7" and insert --1--.

Claim 11, line 1, please delete "7" and insert --1--.

Claim 12, line 1, please delete "7" and insert --1--.

Signed and Sealed this

Fourteenth Day of March, 1995

*Attest:*

Bruce Lehman

BRUCE LEHMAN

*Attesting Officer*

*Commissioner of Patents and Trademarks*